United States Patent [19]

Schweinfurth

[11] Patent Number: 5,036,585

[45] Date of Patent: Aug. 6, 1991

[54] PROCESS FOR THE MANUFACTURE OF AN EXHAUST SILENCER

[75] Inventor: Gustav Schweinfurth, Frankenthal, Fed. Rep. of Germany

[73] Assignee: Grunzweig & Hartmann AG, Ludwigshafen, Fed. Rep. of Germany

[21] Appl. No.: 389,813

[22] Filed: Aug. 4, 1989

[30] Foreign Application Priority Data

Aug. 5, 1988 [DE] Fed. Rep. of Germany ..... 3826707

[51] Int. Cl.[5] ..... B21K 29/00

[52] U.S. Cl. ..... 29/890.08; 29/463; 181/256; 181/282

[58] Field of Search ..... 29/157 R, 157.3 R, 157.3 A, 29/157.3 D, 157.3 C, 463, 469; 181/252, 256, 282

[56] References Cited

U.S. PATENT DOCUMENTS

| | | | |
|---|---|---|---|
| 2,059,487 | 11/1936 | Peik | 181/252 |
| 3,710,891 | 1/1973 | Flugger | 182/256 |
| 3,981,378 | 9/1976 | Potter | 181/252 X |
| 4,026,381 | 5/1977 | Conley | 181/256 X |
| 4,116,303 | 9/1978 | Trudell | 181/256 X |
| 4,263,982 | 4/1981 | Feuling | 181/256 |
| 4,269,800 | 5/1981 | Sommer | 264/113 X |
| 4,513,841 | 4/1985 | Shimoji et al. | 181/252 |
| 4,765,437 | 8/1988 | Harwood et al. | 181/282 |

*Primary Examiner*—Mark Rosenbaum
*Assistant Examiner*—Frances Chin
*Attorney, Agent, or Firm*—Oblon, Spivak, McClelland, Maier & Neustadt

[57] ABSTRACT

In a process for the manufacture of an exhaust silencer for motor vehicles, the advantages derived from employing mineral fiber mouldings are extensively retained while at the same time greatly reducing expenditure on shape-stabilization and transportation. To this end the silencer casing itself is divided in the meridian plane and the mineral wool is supplied and inserted directly into the original silencer casing in the form of precisely dimensioned prefabricated elements which have been impregnated with a suitable fluid, for example pretreated with synthetic resin, but not cured. This enables fast and reliable positioning of the impregnated and manually compressed prefabricated elements around the periphery of the exhaust pipe and the internal component containing the exhaust pipe inside the original silencer casing; once the silencer casing has been closed, the silencer is ready for installation. Curing, hardening or some other time consuming method of shape-stabilization is not necessary. Nevertheless, in comparison with packing the silencer casing with loose mineral wool, a more even fiber distribution is achieved, and the introduction of a specified quantity of fibers is assured through the employment of prefabricated elements, whereby the impregnation of the prefabricated elements renders them soft and pliable and thus easy to work with when placing them in position under compression.

6 Claims, 4 Drawing Sheets

PROCESS FOR THE MANUFACTURE OF AN EXHAUST SILENCER

BACKGROUND OF THE INVENTION

1. Field of the Invention

The invention concerns a process for the manufacture of an exhaust silencer.

In order to reduce the noise emitted by the exhaust systems of motor vehicles, the exhaust pipe is provided along part of its length with perforations around its circumference through which the vibrational energy of the exhaust gases can escape into the surrounding space. This space is enclosed along the length of the perforated pipe section by a sealed silencer casing containing a packing of mineral wool, the sound damping effect of which nullifies the vibrational energy escaping from the exhaust pipe.

2. Description of the Related Art

An obvious process for introducing the mineral wool packing into the silencer casing consists of pushing loose mineral wool between the exhaust pipe and the silencer casing and then finally sealing the silencer casing. The disadvantage here, however, is that the introduction of the loose mineral wool on the part of the silencer manufacturer involves a not inconsiderable amount of work which has an adverse effect on production times; in the cast of mass products such as these manufactured for bulk buyers, namely the automobile industry, such labor-intensive and time-consuming manufacturing processes bring a substantial and adverse influence to bear. Moreover, introduction of the required amount of mineral wool and sufficiently uniform distribution of density cannot be reliably assured and are, rather, dependent upon the skill of the assembly personnel.

For these reasons, a change of practice has taken place whereby the mineral wool is prepared by the mineral wool manufacturer in the shape required for the packing operation, in which form it is then supplied to the silencer manufacturer who then inserts these shape-stabilized packings into the silencer casing.

There are various processes available for stabilizing the shape of such mineral wool packings, involving for example the wrapping of loose mineral wool in a thin sheeting and/or quilt-stitching. One method currently being applied consists of the manufacturer providing the mineral wool with a bonding agent and then curing this, thus stabilizing the shape of the mineral wool element.

The widely applied practice in this case involves the employment of a synthetic resin bonded board from which the required shape is milled. THis produces shapes of very accurate dimensions, thus minimizing disruption to the production process of the silencer manufacturer. A further advantage of this process consists in the fact that the process for manufacture, including the hardening of the boards of mineral wool, can be implemented on a large scale in the usual way without any additional expenditure, by curing the bonding agent employed for stabilizing the shape of the boards in the tunnel drier of the production line belt, so that only the milling operation adds time to the usual felt web production process. However, this process has the disadvantage that the milling operation produces a not inconsiderable amount of waste material which, although it can be re-melted for re-use, has the effect of increasing the cost of the shape-stabilized element manufacturing process.

Moreover, a process is also known from German patent application DE-OS 32 05 186 whereby the mineral wool provided with bonding agent which has not yet been cured is moulded around a core, the shape of which corresponds to that of the exhaust pipe, and then subsequently enclosed by a moulding shell corresponding to the internal contour of the silencer casing, in which position the bonding agent curing process is allowed to take place. When the moulding shell has been opened and the core removed, a single-piece moulding is left in the shape of the required silencer packing, which can then be supplied to the silencer manufacturer and placed by him onto the actual exhaust pipe for insertion into the silencer. One disadvantage of this process lies in the fact that the introduction of the mineral wool into the mould, and mould removal involves a considerable amount of work, and substantial additional time is required for the curing process unless hardening in the tunnel drier is integrated within the production process in the same way as in the case of the manufacture of felts and boards for standard products. The curing process in the special mould thus requires further specific investment and additional energy input, and may also hinder the production process of the mineral wool manufacturer.

This process is, furthermore, only possible if the exhaust pipe, and thus the core corresponding in shape to the exhaust pipe, has the shape of a simple cylinder, so that the moulding, following curing, can be withdrawn and subsequently fitted without difficulty. In the case of bent, bifurcated or otherwise irregularly shaped exhaust pipes in the area of the silencer, this process cannot be employed. In this connection it is known from the German patent specification DE-PS 32 38 638, that the original internal component of the silencer comprising the exhaust pipe and corresponding ancillary elements such as partitions or similar, may be provided by the mineral wool manufacturer with pads or pre-resined but not yet cured mineral wool and, thus prepared, placed in a moulding shell for curing. The mineral wool may also be applied somewhat more thickly to the internal component as it yields prior to curing under the pressure of the subsequently fitted moulding shell. Following the curing process, the composite component formed from the internal component and the cured mineral wool, is removed from the moulding shell and supplied in this condition to the silencer manufacturer who then merely has to insert this composite component laterally into the silencer casing proper.

This process is even more expensive and comprises the following individual manufacturing steps:

1. supply of the finished internal components for the silencer by the silencer manufacturer to the mineral wool manufacturer.

2. manufacture of mineral wool webs with additional application of a synthetic resin bonding agent, 3. production of a large number of pads e.g. by tearing or cutting the required shapes from the mineral wool webs, 4. introduction of the pads and the original internal component into a moulding shell, 5. curing of the bonding agent in a heated facility, 6. de-moulding of the finished composite components, 7. delivery of the composite components comprising the internal components and the cured mineral wool by the mineral wool manufacturer back to the silencer manufacturer.

As is immediately apparent, the considerable expenditure already required for the manufacture of so-called wrap mouldings in accordance with DE-OS 32 05 186 is increased even further by the fact that the introduction of a large number of small individual pads is more labor-intensive than is the wrapping of a straight pipe with a relatively long mineral wool web. Moreover, particularly considerable additional transportation costs are incurred as each original internal component has to be first transported from the silencer manufacturer to the mineral wool manufacturer, and then, following formation of the composite component, from the latter back to the silencer manufacturer.

SUMMARY OF THE INVENTION

In contrast, ~~the~~ invention is based on the technical problem of devising a process, of the species known from the classifying prior art, which not only enables expenditure on transportation to be reduced where required, but which is also implementable without the use of expensive shape-stabilization measures, and in particular without prior curing.

The invention in derived from the knowledge that, for example, mineral wool elements which have been pretreated with resin or impregnated in some other suitable manner exhibit good internal fiber coherence while at the same time remaining soft and pliable so that, when compressed, they extensively retain their compressed shape in that any elastic return to the original shape takes place slowly and remains incomplete. As a result it is possible to shape such elements manually in a manner approximating to plastic deformation and also, at the same time, to compress them such that they essentially remain in this compressed state over a short period of time. Thus an element supplied with a normal bulk density in the order of e.g., 50 kg/m$^3$, the bulk density not having been substantially increased through any immediately preceding initial treatment, can, as part of the process applied to it, be compressed manually to a considerably higher bulk density of e.g., 150 kg/m$^3$; when the compressive pressure is removed, sufficient time still remains before the occurrence of too great a degree of recovery, for fitting the element in its partially compressed condition with its relatively small volume into the silencer and then sealing the silencer case without surplus mineral wool volume becoming lodged between the contact and mating surfaces of the metallic silencer components. The invention is also based on the further knowledge that—unlike in the case of introducing loose mineral wool—working with such mineral wool elements treated with resin results in no major delays in the silencer assembly work itself and makes no special demands on the care and skill of the assembly personnel, provided that these elements are prefabricated in accordance with the specific insertion conditions and requirements of the actual silencer being manufactured, i.e. in the form of the exact standard shapes necessary for each position in the silencer. Thus it is possible to use correspondingly prefabricated elements instead of shape-stabilized packings directly during silencer assembly without any adverse effects on production progress, due in particular to the fact that exact manufacturing enables the employment of prefabricated elements of the maximum possible dimensions. THis, in addition, ensures reproducible compliance with the specified quantities of packing to be introduced and also the required distribution of density.

For this reason, the invention proposes that packings impregnated, i.e. pre-treated, with resin in this way be supplied, for example, in the form of cut, blanked or similarly prefabricated elements instead of shape-stabilized mouldings or milled parts to the place of assembly of the silencer, at which place they can be directly fitted into the silencer itself. The employment of a silencer casing split along the meridian plane enables simple and positionally accurate coverage of the internal component of the silencer with the prefabricated pads. The silencer is then closed along its meridian plane in a manner similar to the moulding shell in the case of the classifying prior art. The employment here of large-area prefabricated elements instead of a large number of more or less irregular pads excludes the possibility of protruding mineral wool elements becoming clamped between closely fitting and mating metal surfaces of the silencer casing and the internal component. No curing process is required at all as there is no need for the shape-stabilization of a moulding which has to be transported without an external casing. Moreover, impregnation of the prefabricated elements, which renders them soft and pliable, need not necessarily be by means of a bonding agent, and can instead be carried out with any suitable impregnating fluid, as following installation in the silencer, the bonding agent essentially looses its function and quickly burns away once the motor vehicle has been started up. The impregnating agent can therefore be selected on the basis of other criteria, for example its environmental compatibility during operation of the motor vehicle, its ready availability, its low cost, its ease of use and low nuisance value, etc.

If the silencer is assembled at the silencer manufacturer's premises, the impregnated prefabricated elements merely have to be transported to these premises, resulting in a reduction in transport costs even in comparison with the transportation of shape-stabilized elements by themselves. Alternatively, the silencer assembly work may, if required, be carried out at the mineral wool manufacturer's premises in order to reduce the work load borne by the silencer manufacturer's production department. Although here, in contrast to the procedure according to DE-OS 32 38 638, the original silencer casing also has to be transported in addition to the internal component or composite component, and there is consequently a slight increase in the transport costs, in return the silencer manufacturer performs none of the assembly work, instead merely supplying the metal components manufactured by him to the mineral wool manufacturer and then receiving from the latter the finished silencer. Total transport costs may also be reduced, provided the timing of the deliveries can be properly coordinated, by the mineral wool manufacturer shipping the silencer assembled and finished by him directly to the silencer manufacturer's customer, i.e., the automobile manufacturer, thus eliminating transportation from the silencer manufacturer to the automobile manufacturer; this is made possible by the invention by the fat that, once the impregnated mineral wool packing has been introduced into the silencer casing and the silencer casing has been closed and sealed, no further work on the silencer is required.

In the case of silencer casings with an elliptical or similar cross-section in particular, a reduction in differences in density is achieved in a simple manner.

If the customer requires a layer of metal wool between the mineral wool and the external surface of the exhaust pipe in order to improve the exhaust behavior, then the metal wool can be fitted over a straight exhaust pipe in the form of a metal fiber stocking during the assembly work prior to insertion of the prefabricated mineral wool packing element, or held in position by some other means, e.g. by spot-soldering it to the internal component. Alternatively, it can be secured to that surface of the prefabricated packing element which faces the internal component when the element is fitted in position. A mechanical securing means can be employed, for example quilt stitching or an adhesive requiring no thermal influence to induce setting which might adversely affect the impregnating agent of the mineral wool.

It may be possible to produce sufficient adhesion between the metal fiber layer and the prefabricated mineral wool element by mere contact pressure, so that adequate positional location in obtained by the interlocking and adhesion between the fibers to enable the composite elements thus formed to be effectively handled and positioned during the assembly work.

A number of liquids are suitable as the impregnating agent of mineral wool such as this, in addition to the usual synthetic resin bonding agents employed. Preference is given to a water-oil emulsion which provides for an improved fiber-to-fiber adhesion of the mineral wool, and thus further stabilizes the outline shape of the prefabricated element. Such an emulsion is known, for example, from German patent application DE-OS 36 16 454 to which reference may be made for further details. During operation of the motor vehicle, the water evaporates free of residues and without causing any environmental pollution, while the environmental pollution caused by the oil component is negligible. Aside from its ready availability and low cost, such an emulsion also has the advantage of making the prefabricated elements comfortable to handle during the assembly work. Further details, features and advantages of the invention are indicated in the following description of an example case in which reference is made to the drawings.

DESCRIPTION OF THE PREFERRED EMBODIMENTS

Figure 1:
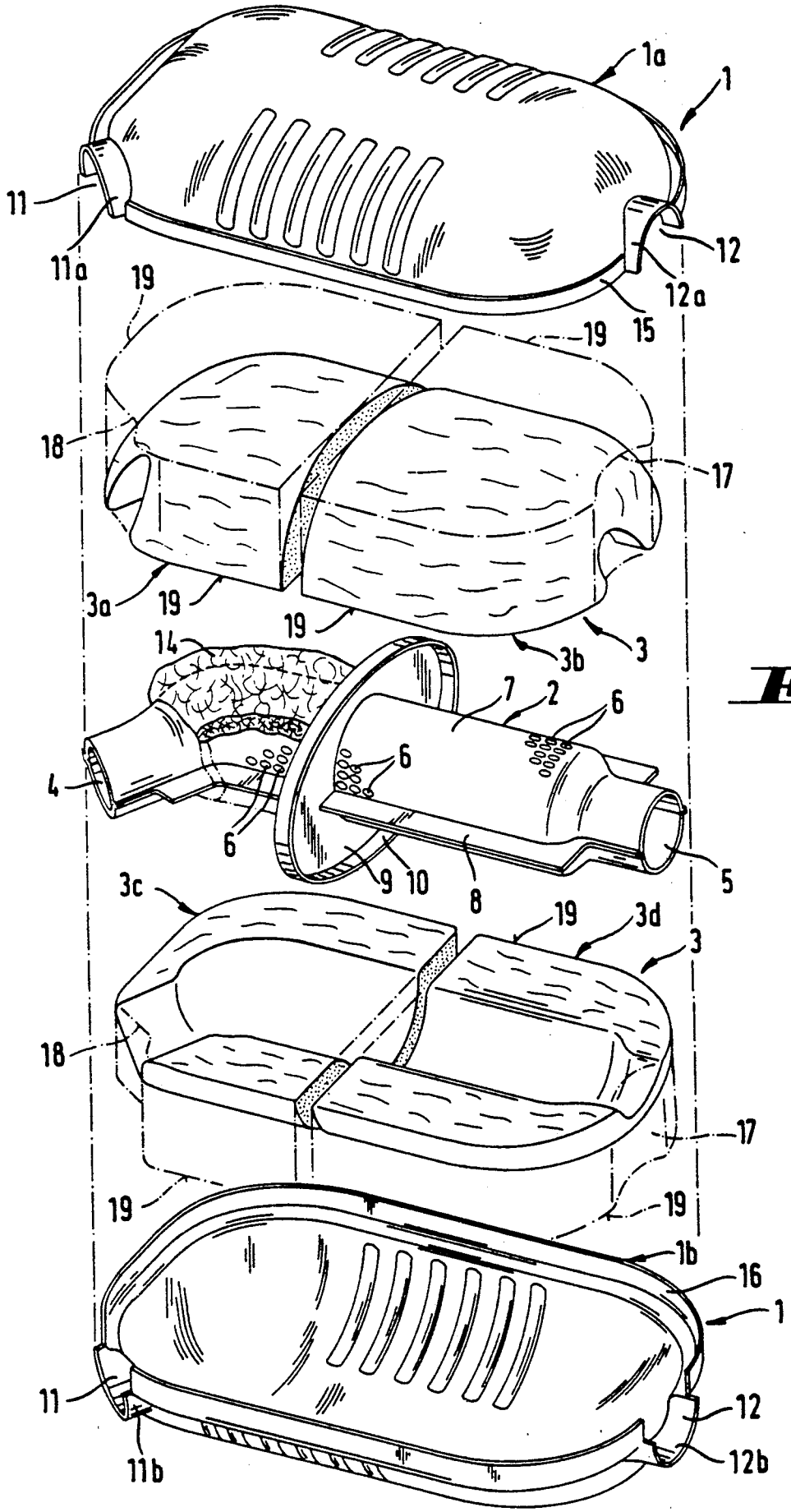
FIG. 1 shows an exploded representation of a silencer manufactured using the process according to the invention.

As is apparent from FIG. 1, an exhaust silencer manufactured in accordance with the invention comprises a casing 1 with an upper casing half 1*a* and a lower casing half 1*b*, an internal component 2 and a packing 3 of mineral wool, in this example in the form of four prefabricated elements 3*a*, 3*b*, 3*c* and 3*d*, arranged between the internal component 2 and the silencer casing 1.

The internal component 2 exhibits a front connection stub 4 and a rear connection stub 5 for connection to the exhaust line, not illustrated, for example in the exhaust system of a motor vehicle. Between connection stubs 4 and 5, the internal component 2 exhibits a tubular section 7 which is provided with perforations 6. The tubular section 7 of metal is, in this example, manufactured from two halves which are connected to each other at a flange 8 lying in the meridian plane. IN a middle section between connection stubs 4 and 5 a distance disc 9 is arranged radially around the circumference of the tubular section 7, said distance disc 9 having a radial support land 10 running around its external circumference, the contour of which support land 10 corresponds to the internal contour of its corresponding contact surface in the silencer casing 1.

Openings 11 and 12 are provided at the casing halves 1*a* and 1*b* of the silencer casing 1 for the connection stubs 4 and 5 of the internal component 2. In view of the fact that the partition joint of the silencer casing 1 lies in a meridian plane 13 illustrated in FIG. 4, in which meridian plane 13 the flange 8 of the internal component 2 also lies, openings 11 and 12 are designed as half sleeves 11*a*, 12*a* and 11*b*, 12*b* which are arranged at their respective casing halves 1*a* or 1*b*, and which surround the connection stubs 4 and 5 when the silencer casing 1 is closed. In this position, the supporting land 10 is located in a snug fit at the corresponding contact surface of the silencer casing 1, thus assuring retention of the required position of the internal component 2 within the silencer casing 1.

When the exhaust gas silencer is in operation, pulsating exhaust gas flows through the pipe section 7 under high vibrational energy. Through the perforations 6, the pressure produced by the vibrational energy can be attenuated by the surrounding packing 3 of mineral wool which, as a result of its sound absorption capacity, nullifies a major proportion of the vibrational energy, giving rise to the noise-damping effect of the exhaust silencer.

As the exhaust gas exhibits both a high temperature and high vibrational energy, a reduction in the cohesion of the mineral fibers in the packing 3 may occur over length periods of operation, with the result that individual mineral fibers may escape from the packing, pass through the perforations 6 and be blown out with the exhaust gas stream in pipe section 7. To protect the mineral fibers of packing 3 in the sense of improving exhaust behavior, an additional layer 14 of metal wool can be introduced between the external surface of the tube section 7 in the area of the perforations 6, and the internal surface of the packing 3, thus protecting the mineral wool from immediate contact with the hot exhaust gases.

Current successful practice involves providing the silencer manufacturer with the packing 3 in the form of shaped elements such as are illustrated by way of example in FIG. 1, whereby the prefabricated elements 3*a*, 3*b*, 3*c* and 3*d* in such a case would contain the type of cured bonding agent normal for such purposes so that they retain the shape shown in the illustration. The manufacture of such shape-stabilized elements either takes the form of a material-yielding machining operation carried out on an appropriately hardened mineral fiber board (milled elements), or by curing the mineral wool impregnated with a bonding agent in a mould through the application of heat. As is immediately apparent, such shape-stabilized elements can be employed by the silencer manufacturer, without the likelihood of any problems arising, as accurately dimensioned engineering components which are simply placed together with the internal component 2 into the silencer casing 1, which is then closed and sealed. An alternative procedure consists in covering the original internal component 2 with pads containing still uncured bonding agent, and then placing it into a moulding shell, corresponding to the contour of the silencer casing 1, in which shell the curing process then takes place, whereby the thus formed composite component, on delivery to the silencer manufacturer, is inserted into the silencer casing as a single piece.

As explained above, all these procedures have certain disadvantages, particularly in regard of the manufacturing and transportation costs which ensue. Where so-called milled elements are employed, the disadvantages lie in the addition expenditure for the milling operation and also the material wastage which occurs; where cured mouldings are employed, whether individually manufactured or produced by covering the internal component with the appropriate padding, the disadvantage lies in the cost of a separate curing process; furthermore, in arrangements involving the delivery of an internal component covered with the cured packing, considerable additional transport costs arise from delivering and returning the original internal components.

From the point of view of the mineral wool manufacturer, the simplest method would naturally be that of supplying loose mineral wool or mineral wool felt torn or cut from suitable pieces, which can be pushed into a silencer casing of closed circumference. However, the silencer manufacturer is then unable, within the constraints of reasonable expenditure, to produce a packing which satisfies the quality requirements. It should also be remembered here that the bulk density of a mineral wool felt, supplied without substantial precompression, in the order of 50 kg/m$^3$ has to be considerably increased by compression to, for example, 150 kg/m$^3$ and more so that the mineral wool is able to fulfil efficiently the functions assigned to it in the silencer. Such a high degree of compression during the assembly of the silencer causes insurmountable practical difficulties in view of the fact that, in addition, the amount of mineral wool introduced and its density distribution must also meet predetermined requirements. It must also be ensured that the half sleeves 11*a*, 11*b* and 12*a*, 12*b* fit snugly around the external periphery of connection stubs 4 and 5; the support land 10 must fit snugly against the internal contour of the metallic silencer casing 1; and the peripheral flanges 15 and 16 of casing halves 1*a* and 1*b* of the silencer casing 1, lying in the meridian plane 13, must mate perfectly, giving rise to the requirement that no mineral wool must be present at any of these points.

Figures 2, 2A, 2B:
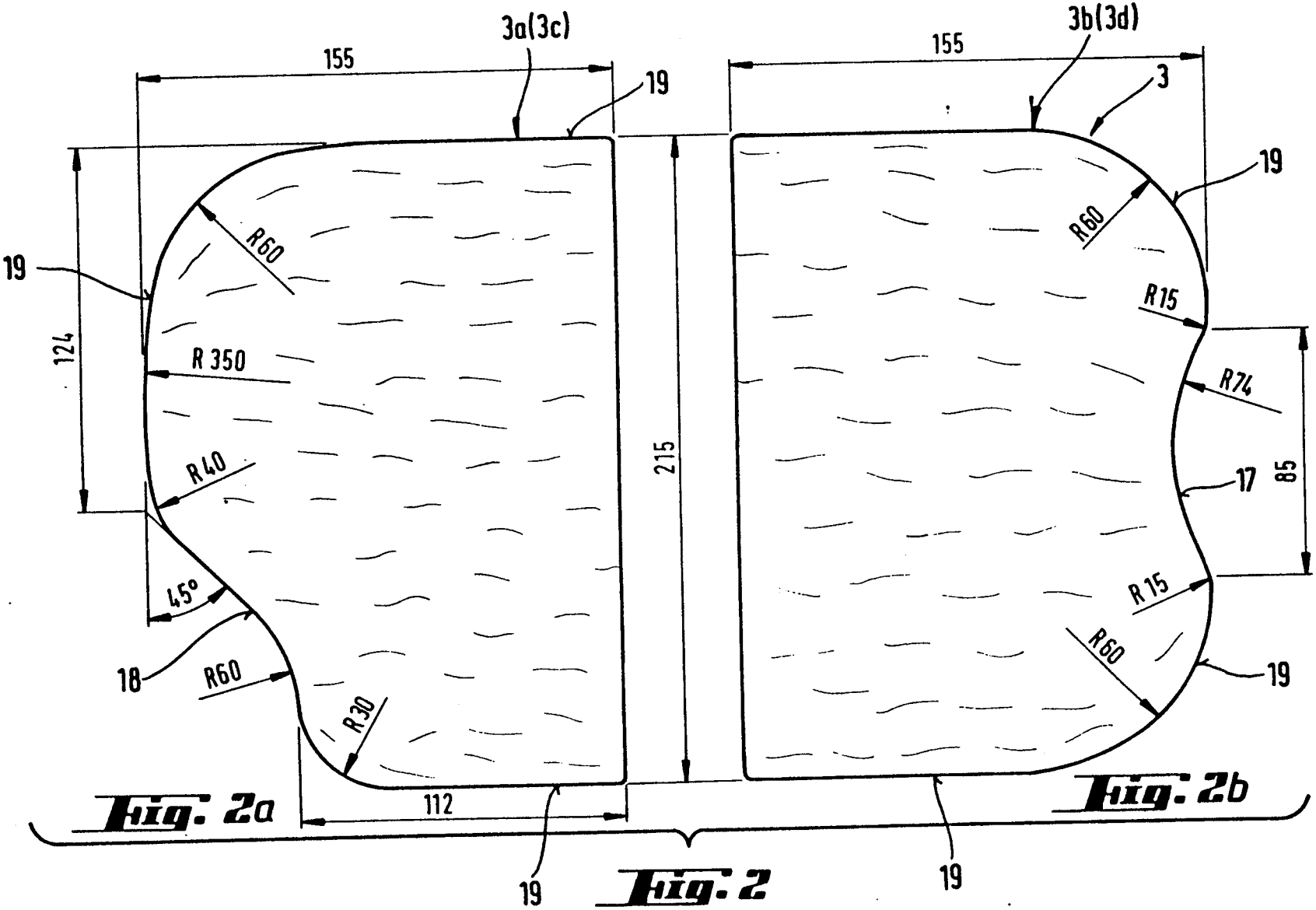
FIG. 2 shows two inserts employed for the manufacturer of this silencer, in the form of precisely prefabricated elements which together form the top part of the silencer packing.

In the case of the process according to the invention, instead of shape-stabilized elements, impregnated and in particular bonding agent-containing but not yet cured prefabricated elements 3*a*, 3*b*, 3*c* and 3*d* are used which are precisely manufactured in accordance with the installation conditions in the silencer. The prefabricated elements 3*c* and 3*d* for formation of the lower part of packing 3 in FIG. 1 are shown in a plan view in FIG. 2. In the example case they are punched out of a mineral wool web with a thickness of 50 mm to the exact shape required, and exhibit recesses 17, 18 in the area of the connection stubs 4 and 5. As is also schematically shown in the representation in FIG. 1, these precisely dimensioned recesses 17 and 18 result in a reduced volume of material in these particular areas and thus, in spite of the uniform of the uniform depth of the prefabricated elements 3*a*, 3*b*, 3*c* and 3*d*, enable the thickness of the packing to be reduced in this area without any concomitant pinching. The precise contour of the prefabricated elements 3*a*, 3*b*, 3*c* and 3*d* is best determined empirically; in any case it is assured that a contour providing a suitable deformation pattern is provided which, when compressed, always produces the same changes in shape, so ensuring reproducible results.

In this way, transportation costs can be minimized whereby only the impregnated, but as yet uncured prefabricated elements 3*a*, 3*b*, 3*c* and 3*d* are supplied to the silencer manufacturer, who then uses the prefabricated elements in a manner similar to that employed for shape-stabilized elements, inserting them directly into the silencer casing, without any costs for curing the mouldings or milling the shapes being incurred by the mineral wool manufacturer. Of essential importance is the fact that the prefabricated elements 3*a*, 3*b*, 3*c* and 3*d* impregnated, for example, with a bonding agent which has not yet been cured, differ considerably in their consistency from loose mineral wool which contains no bonding agent or has not been impregnated; the impregnation process greatly increases the pliability of the material and also improves fiber cohesion, so that the prefabricated elements can be readily subjected to plastic deformation whereby, provided this deformation is not too extreme, they tend to regain their original shape through elastic recovery only at a very slow rate. Where moderate manual compression is applied to such a prefabricated element, for example, the element initially retains its compressed shape on removal of the pressure, and only partially and very slowly recovers its shape. On the other hand, the cohesion of the fibers is so good that fraying or similar of the edges, designated 19, of the prefabricated elements does not occur, even when they are subjected to plastic deformation; instead they remain in their original smooth condition.

Figure 3:
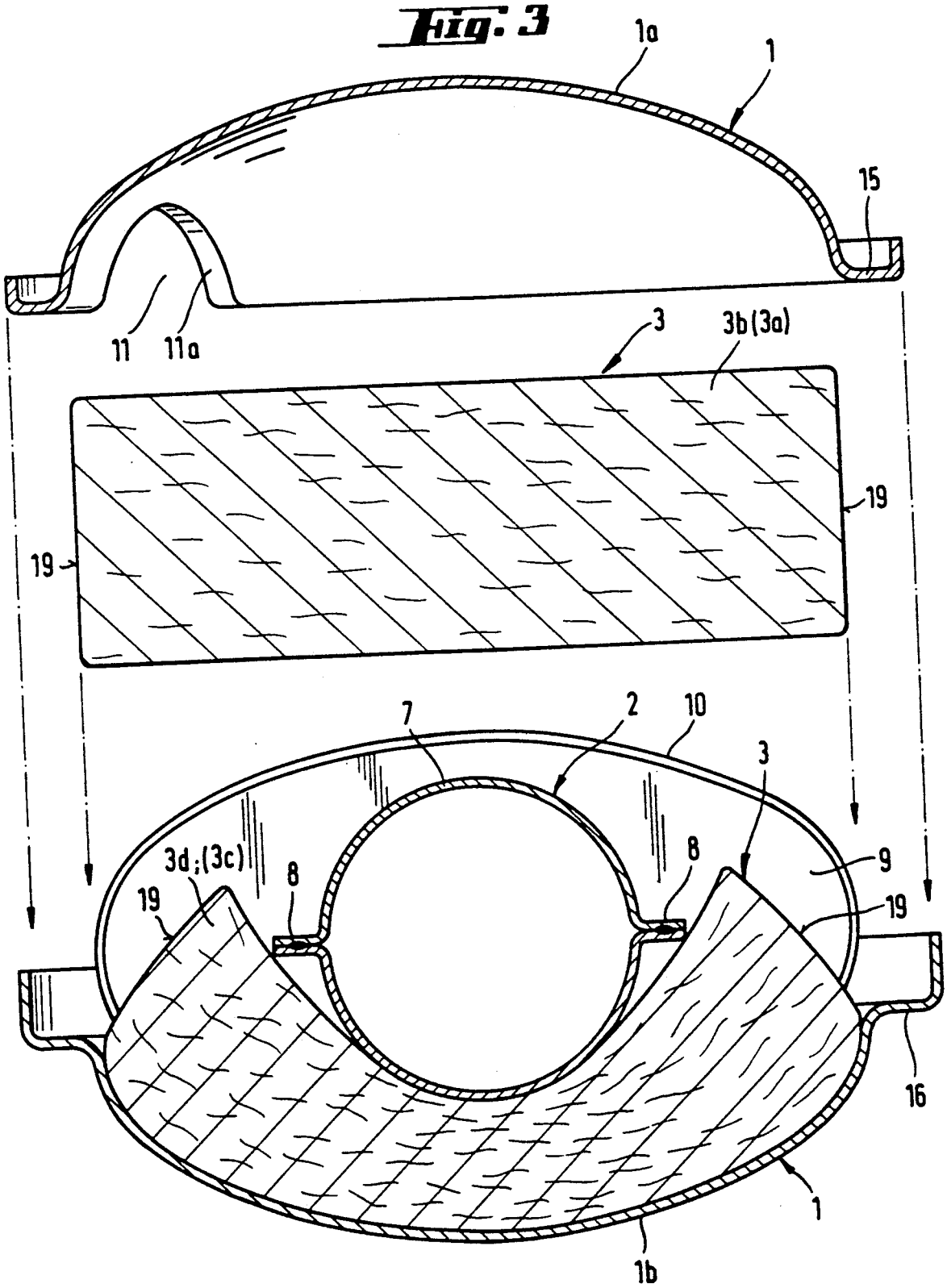
FIG. 3 shows a representation similar to that shown in FIG. 1 depicting a cross section through a partly manufactured silencer.

The silencer assembly procedure is more closely illustrated in FIG. 3.

As indicated, firstly the bottom prefabricated elements 3*c* and 3*d* shown in FIG. 1 are inserted in the lower casing half 1*b* of the silencer casing 1, whereby, during placement, they are not, or are only slightly, manually compressed. The internal component 2 is then placed in the bottom casing half 1 so that the distance disc 9 with the support land 10 slots into a gap between the prefabricated elements 3*c* and 3*d*, and the internal component 2 and the tubular section 7 press down into the lower prefabricated elements 3*c* and 3*d* as shown in FIG. 3. As is immediately apparent, the pressure exerted on internal component 2 results in the side edges 19 of the prefabricated elements 3*c* and 3*d* to tilt inwards towards the tubular section 7 as a result of the improved cohesion of the fibers of the mineral wool produced by impregnation, thus creating a clearance between the edges 19 and the peripheral flange 16. The good cohesion of the fibers at the end face edges 19 ensures that there, too, no bunching or fraying takes place in the direction of the metallic components, so that material does not protrude over critical points and is prevented from interfering with the metallic mating and contact surfaces.

Figure 4:
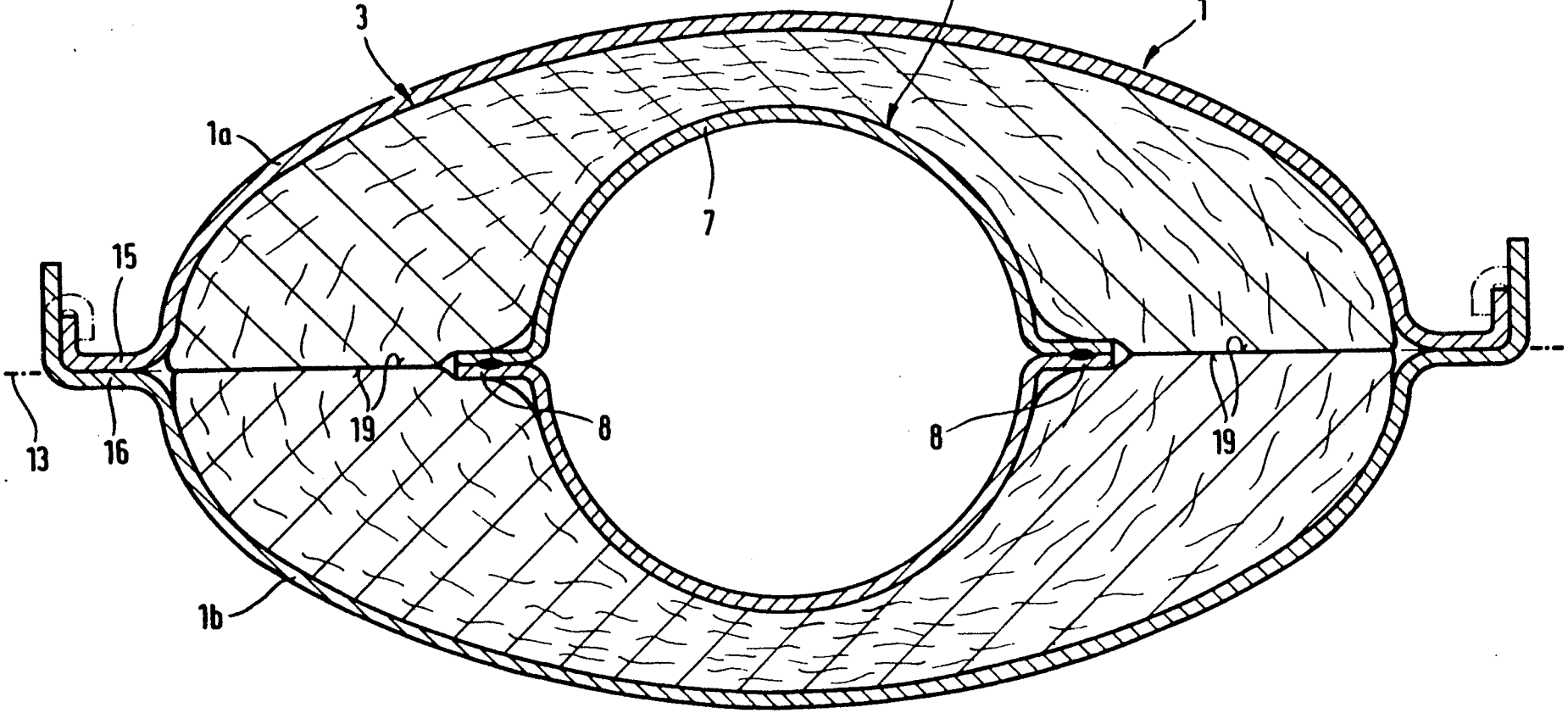
FIG. 4 shows, in a representation corresponding to that shown in FIG. 3, a cross-section through a finished silencer manufactured by applying the process according to the invention.

The upper prefabricated elements 3*a* and 3*b* are then placed onto the internal component 2 which is embedded in prefabricated elements 3*c* and 3*d*, and are then subjected to manual precompression. After the upper casing half 1*a* is placed in position, the two casing halves 1*a* and 1*b* can be pressed together to form the finished silencer casing 1, as illustrated in FIG. 4, thus compressing the packing 3 of mineral wool into the final shape required without any interference with the metallic mating and contact surfaces. In this way the prefabricated elements 3*a*, 3*b*, 3*c* and 3*d* are predominantly resting against one another with their edges 19, which are lateral when the elements are in the flat condition, now lying in the meridian plane 13 so that in the example case of an elliptical silencer casing 1, a large volume of mineral wool is present on both sides of the tubular section 7, and the enlarged gap present there is filled with packing of sufficient density.

As in particularly apparent from FIG. 4, in this example case, the width of the prefabricated elements 3*a*, 3*b*, 3*c* and 3*d* largely corresponds to the arc length of the wall of their respective casing half 1*a* or 1*b* at the point of installation, so that, as is also illustrated in FIG. 3, pressing the various prefabricated elements against the curved wall of the appropriate casing half causes the edges 19 to turn laterally inwards, ending in the area of the meridian plane 13 and blending into the bottom face of the prefabricated element. However, in the case of other silencer designs, skilled selection of the arrangement and contour of the prefabricated elements, and also corresponding supplementary experiments will also always ensure that the mineral wool of the prefabricated elements is deformed through compression in such a way as to pack thoroughly all the essential spaces for effective sound absorption, and so that differences in mineral wool density within the finished silencer are limited.

If, as is indicated in FIG. 4, the edges of casing halves 1*a* and 1*b* are finally folded over in the usual way in the area of peripheral flanges 15 and 16, the silencer becomes hermetically sealed having been provided with a suitable packing. There is no need for any additional curing process in order to harden the packing where a bonding agent is employed as the impregnating fluid, as in this finished condition no additional shape-stabilization of the mineral wool is required. In cases where a bonding agent is employed as the impregnating fluid, however, curing will take place under the influence of the hot combustion gases when the motor vehicle is initially started up. This is not, however, deleterious and may also be advantageous through an ensuing improvement in exhaust behavior, as the position of the individual fibers in their final condition is further consolidated.

As is immediately apparent from the above description, layers 14 of metal wool, particularly in stocking form, can be fitted to the internal component 2 prior to insertion of the packing 3, for example by sliding it over or soldering it to the internal component 2. As an alternative, however, it is also possible to apply a corresponding layer 14 of metal wool or similar to the prefabricated elements 3*a*, 3*b*, 3*c* and 3*d*, for example by quilt stitching or adhesion, or even simply by making use of the adhesion which results from fiber interlock. Such a practice results in a certain modification to the bending behavior of the sides of prefabricated elements 3*a*, 3*b*, 3*c* and 3*d* adjacent to the internal component 2, which undergo a high degree of deformation. This modification in deformation behavior can be utilized if required to produce specific local reductions in deformability.

Synthetic resin bonding agents, such as are normally used for hardening mineral fiber mouldings or boards, have proven to be particularly advantageous with regard to the deformation behavior and handling of the mineral wool elements; however, as the curing of the bonding agent is only of minor importance, another impregnating fluid can also be employed in order to produce the required consistency and the desired behavior of the prefabricated elements, such as, for example, a water-in-oil emulsion or similar.

I claim:

1. A process for the manufacture of a silencer comprising a silencer casing and having a perforated internal component for conducting an exhaust gas flow, said silencer comprising packing elements of mineral wool containing an impregnating agent for rendering said packing elements soft and pliable arranged in spaces between the internal component and the silencer casing, wherein said internal component is covered with said elements of mineral wool, and wherein this arrangement is surrounded by a form corresponding to an internal space of the silencer casing, said process comprising the steps of:

employing an opened silencer casing which is separated in its meridian plane into two casing halves, wherein said silencer casing can be permanently closed at its partition plane;

prefabricating the impregnated packing elements in accordance with their respective positions within the silencer;

introducing the impregnated prefabricated packing elements into the opened silencer at a silencer assembly place, together with the internal component, through compression, wherein the silencer casing is then permanently closed; and employing the silencer provided with the impregnated prefabricated packing elements, without prior heat-treatment of the prefabricated elements, for installation within an exhaust pipe system.

2. A process as claimed in claim 1, wherein the prefabricated elements are ready-made to a width which at least approximates an arc length of an internal wall of at least one of said casing halves between its lateral edges at the place in which said prefabricated elements are fitted.

3. A process as claimed in claims 1 or 2, wherein a layer of metal fibers is secured to that surface of the prefabricated elements, prior to their installation, which, in their installation position, faces the internal component.

4. A process as claimed in claim 3, wherein mechanical means such as stitching or an adhesive is employed in order to secure the layer of metal fibers to the mineral wool.

5. A process as claimed in claim 1, wherein a water-oil emulsion is employed as the impregnating agent.

6. The process as claimed in claims 1 or 2, comprising the further step of:

covering the internal component with a metal fiber layer at perforated areas prior to being covered with the prefabricated elements.

* * * * *